US005833065A

United States Patent [19]

Burgess

[11] Patent Number: 5,833,065

[45] Date of Patent: Nov. 10, 1998

[54] COMBINATION TOOL BOX

[76] Inventor: Larry R. Burgess, 5210 Foxcross, San Antonio, Tex. 78219-2021

[21] Appl. No.: 990,308

[22] Filed: Dec. 15, 1997

[51] Int. Cl.[6] ..... B65D 85/28

[52] U.S. Cl. ..... 206/373; 206/508; 220/23.83

[58] Field of Search ..... 206/373, 372, 206/508, 501; 220/324, 326, 23.6, 23.8, 23.83, 23.86

[56] References Cited

U.S. PATENT DOCUMENTS

| | | | |
|---|---|---|---|
| 4,984,687 | 1/1991 | Hanna et al. | 206/373 |
| 5,004,103 | 4/1991 | Connors et al. | 206/372 |
| 5,011,013 | 4/1991 | Meisner et al. . | |
| 5,040,681 | 8/1991 | Grusin | 206/372 |
| 5,083,674 | 1/1992 | Clark | 206/508 |
| 5,301,829 | 4/1994 | Chrisco . | |
| 5,344,339 | 9/1994 | Cheslock . | |
| 5,386,907 | 2/1995 | Kahl et al. . | |
| 5,503,571 | 4/1996 | Cheslock . | |
| 5,507,385 | 4/1996 | Koloski et al. . | |

*Primary Examiner*—Paul T. Sewell
*Assistant Examiner*—Nhan T. Lam
*Attorney, Agent, or Firm*—Joseph N. Breaux

[57] ABSTRACT

A combination tool box that includes a lower tool chest member, a completely detachable, combined tool chest lid member and top tool box, and three pivoting securing mechanisms. Two of the three pivoting securing mechanisms secure the tool chest to the combined tool chest lid member and top tool box. The remaining pivoting securing mechanism secures the hinged tool box top of the top tool box in the closed position. The hinged tool box top has a handle receiving recess formed therein and a pivoting handle pivotally attached to the hinged tool box top in a manner to pivot into the handle receiving recess. Each of the three pivoting securing assemblies includes a lower fixed portion, an assembly hinge, a resilient pivoting clip portion, and a locking bolt assembly. Each of the locking bolt assemblies includes a bolt actuator having a head portion and a body portion including a guide slot and two bolt contacting surfaces; and two slidably mounted locking bolts each having an angled actuator contact surface and a resilient return band connected to an interior surface of the pivoting clip portion.

16 Claims, 3 Drawing Sheets

COMBINATION TOOL BOX

TECHNICAL FIELD

The present invention relates to tool boxes and more particularly to a combination tool box that includes a lower tool chest member, a completely detachable, combined tool chest lid member and top tool box, and three pivoting securing mechanisms; the lower chest member having two pivoting securing assemblies attached to opposed sidewalls thereof, a tool storage compartment formed therein and a chest opening in connection with the tool storage compartment; the combined tool chest lid member and top tool box including a lid portion that is sized and shaped seal the chest opening of the lower chest member, a tool box portion integrally formed with the lid portion having a tool box storage cavity formed therein and a pivoting securing assembly attached to a tool box wall thereof, a hinged tool box top having a handle receiving recess formed therein, and a pivoting handle pivotally attached to the hinged tool box top in a manner to pivot into the handle receiving recess; each of the three pivoting securing assemblies including a lower fixed portion, an assembly hinge, a resilient pivoting clip portion, and a locking bolt assembly including a bolt actuator having a head portion and a body portion including a guide slot and two bolt contacting surfaces; and two slidably mounted locking bolts each having an angled actuator contact surface and a resilient return band connected to an interior surface of the pivoting clip portion; the lid portion including two lid portion receiving depressions each including a lid portion central open depression and two lid portion cylinder shaped bolt receiving cavities formed therein; the hinged tool box top having a box top receiving depression formed therein that includes a box top central open depression and two box top cylinder shaped bolt receiving cavities; the lid portion providing a tool positioning surface having the tool box portion extending outwardly away from the center thereof.

BACKGROUND ART

It is often desirable to have a tool box for storing and transporting tools. The tool box typically includes a lower box portion having a hinged top that is provided with a handle for lifting and carrying the tool box. Although tool boxes provide a convenient mechanism for transporting and storing a variety of tools, they can often become filled with a hodgepodge of different sized tools that results in a disorganized mess within the toolbox that can make it difficult to find smaller tools conveniently. It would be a benefit, therefore, to have a tool box that included a tool box storage cavity for storing smaller tools, such as screw drivers wrenches and the like, and a separate tool chest storage compartment for storing larger tools, such as power drills, jig saws and the like. Although dual tool storage compartments can be achieved by providing two separate tool boxes, use of two tool boxes can require the user to use both hands to carry the tools. It would be a benefit, therefore, to have a combination tool box that included a tool box and a tool chest that are detachable from each other but that can be linked together to allow both the tool box and the tool chest to be lifted by a single handle.

GENERAL SUMMARY DISCUSSION OF INVENTION

It is thus an object of the invention to provide a combination tool box that includes a tool box storage cavity for storing smaller tools, such as screw drivers wrenches and the like, and a separate tool chest storage compartment for storing larger tools, such as power drills, jig saws and the like.

It is a further object of the invention to provide a combination tool box that includes a tool box and a tool chest that are detachable from each other but that are linked together to allow both the tool box and the tool chest to be lifted by a single handle.

It is a still further object of the invention to provide a combination tool box that includes a lower tool chest member, a completely detachable, combined tool chest lid member and top tool box, and three pivoting securing mechanisms; the lower chest member having two pivoting securing assemblies attached to opposed sidewalls thereof, a tool storage compartment formed therein and a chest opening in connection with the tool storage compartment; the combined tool chest lid member and top tool box including a lid portion that is sized and shaped seal the chest opening of the lower chest member, a tool box portion integrally formed with the lid portion having a tool box storage cavity formed therein and a pivoting securing assembly attached to a tool box wall thereof, a hinged tool box top having a handle receiving recess formed therein, and a pivoting handle pivotally attached to the hinged tool box top in a manner to pivot into the handle receiving recess; each of the three pivoting securing assemblies including a lower fixed portion, an assembly hinge, a resilient pivoting clip portion, and a locking bolt assembly including a bolt actuator having a head portion and a body portion including a guide slot and two bolt contacting surfaces; and two slidably mounted locking bolts each having an angled actuator contact surface and a resilient return band connected to an interior surface of the pivoting clip portion; the lid portion including two lid portion receiving depressions each including a lid portion central open depression and two lid portion cylinder shaped bolt receiving cavities formed therein; the hinged tool box top having a box top receiving depression formed therein that includes a box top central open depression and two box top cylinder shaped bolt receiving cavities; the lid portion providing a tool positioning surface having the tool box portion extending outwardly away from the center thereof.

It is a still further object of the invention to provide a combination tool box that accomplishes some or al of the above objects in combination.

Accordingly, a combination tool box is provided. The combination tool box includes a lower tool chest member, a completely detachable, combined tool chest lid member and top tool box, and three pivoting securing mechanisms; the lower chest member having two pivoting securing assemblies attached to opposed sidewalls thereof, a tool storage compartment formed therein and a chest opening in connection with the tool storage compartment; the combined tool chest lid member and top tool box including a lid portion that is sized and shaped seal the chest opening of the lower chest member, a tool box portion integrally formed with the lid portion having a tool box storage cavity formed therein and a pivoting securing assembly attached to a tool box wall thereof, a hinged tool box top having a handle receiving recess formed therein, and a pivoting handle pivotally attached to the hinged tool box top in a manner to pivot into the handle receiving recess; each of the three pivoting securing assemblies including a lower fixed portion, an assembly hinge, a resilient pivoting clip portion, and a locking bolt assembly including a bolt actuator having a head portion and a body portion including a guide slot and two bolt contacting surfaces; and two slidably mounted locking bolts each having an angled actuator contact surface and a resilient return band connected to an interior surface of the pivoting clip portion; the lid portion including two lid portion receiving depressions each including a lid portion central open depression and two lid portion cylinder shaped bolt receiving cavities formed therein; the hinged tool box top having a box top receiving depression formed therein that includes a box top central open depression and two box top cylinder shaped bolt receiving cavities; the lid portion providing a tool positioning surface having the tool box portion extending outwardly away from the center thereof.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
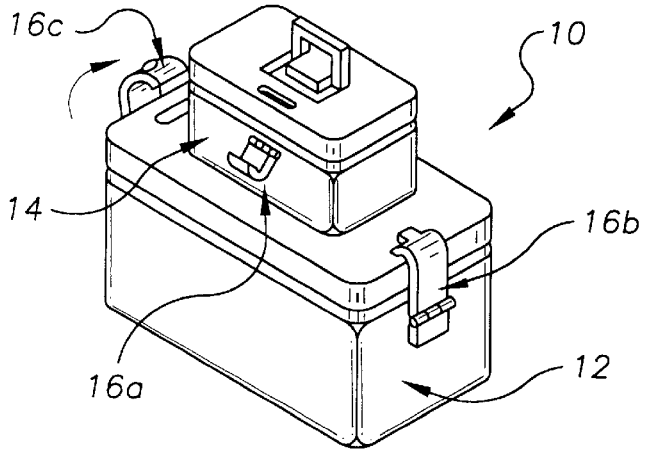
FIG. 1 is a perspective view of the combination tool box showing the lower tool chest member; the completely detachable, combined tool chest lid member with the top tool box with the tool box portion extending outwardly away from the center of the tool positioning surface of the lip portion and the hinged tool box top with the pivoting handle seated pivotally connected to the tool box portion; and the three identical pivoting securing assemblies.

FIG. 1 shows an exemplary embodiment of the combination tool box of the present invention, generally designated by the numeral 10. In this embodiment, combination tool box 10 includes a molded plastic lower tool chest member, generally designated 12; a completely detachable, combined tool chest lid member and top tool box, generally designated 14; and three identical pivoting securing mechanisms, generally designated 16*a–c*.

Combined tool chest lid member and top tool box 14 includes a top tool box, generally designated 18, and a lid portion, generally designated 20. Top tool box 18 includes a tool box portion 22, a hinged tool box top 24, and pivoting securing mechanism 16*a*. Tool box portion 22 is integrally molded with and extends outwardly from the center of a tool positioning surface 26 of lid portion 20. A tool box storage cavity 28 is formed into tool box portion 22 that is sealable by pivoting hinged tool box top 24 at a hinge 30 that hingedly connects hinged tool box top 24 to tool box portion 22.

Figure 3:
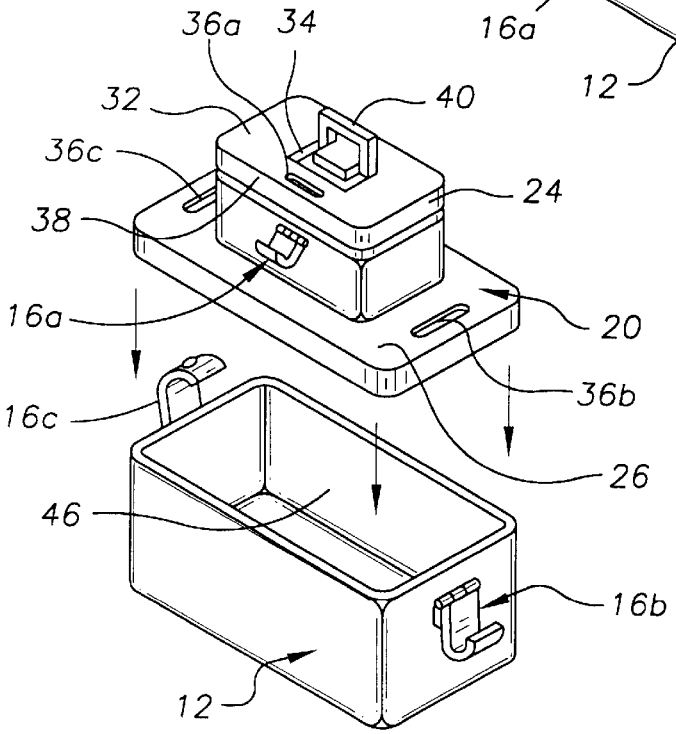
FIG. 3 is an exploded perspective view of the combination tool box showing the combined tool chest lid member and top tool box exploded away from the lower tool chest member revealing the tool storage compartment formed into the lower tool chest member and the chest opening in connection with the tool storage compartment.

With reference now to FIG. 3, hinged tool box top 24 has an upper surface 32 having a U-shaped handle receiving recess 34 formed into the center thereof and a box top securing bolt receiving depression 36*a* formed adjacent to a forward side edge 38 thereof at a location to allow for engagement of pivoting securing mechanism 16*a*. A U-shaped, molded plastic pivoting handle 40 is pivotally connected to tool box top 24 and pivots downward for storage into U-shaped handle receiving recess 34. Tool positioning surface 26 of lid portion 20 is provided with two lid portion securing bolt receiving depressions 36*b*,36*c* that are formed adjacent to opposed side edges thereof and positioned, respectively to allow engagement with pivoting securing mechanisms 16*b*,16*c*. In this embodiment, the two lid portion securing bolt receiving depressions 36*b*,36*c* and box top securing bolt receiving depression 36*a* are identical.

Figure 2:
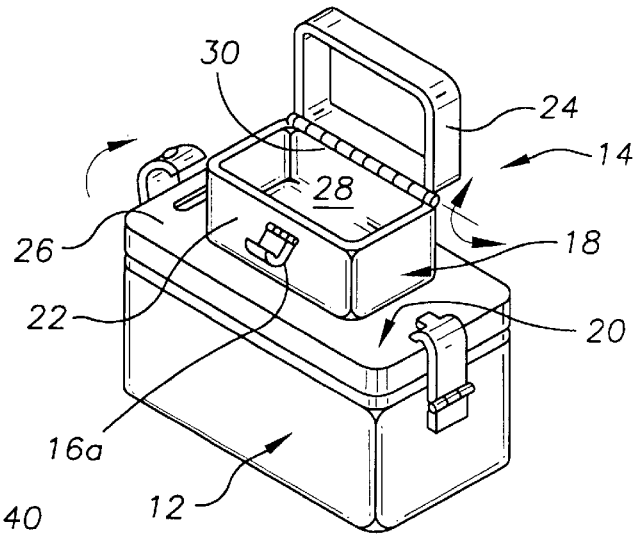
FIG. 2 is a second perspective view of the combination tool box showing the hinged tool box top of the top tool box in the open position showing the tool box storage cavity.

Lower tool chest member 12 has a tool storage compartment 46 formed therein that has volume greater than twice the volume of tool box storage cavity 28 (FIG. 2). In use, tool storage compartment 46 is used to store large tools such as saws, electric drills, electric sanders, etc. Tool box storage cavity 28 (FIG. 2) is used to store smaller hand tools such as screw drivers, drill bits, wrenches, etc.

Figure 4:
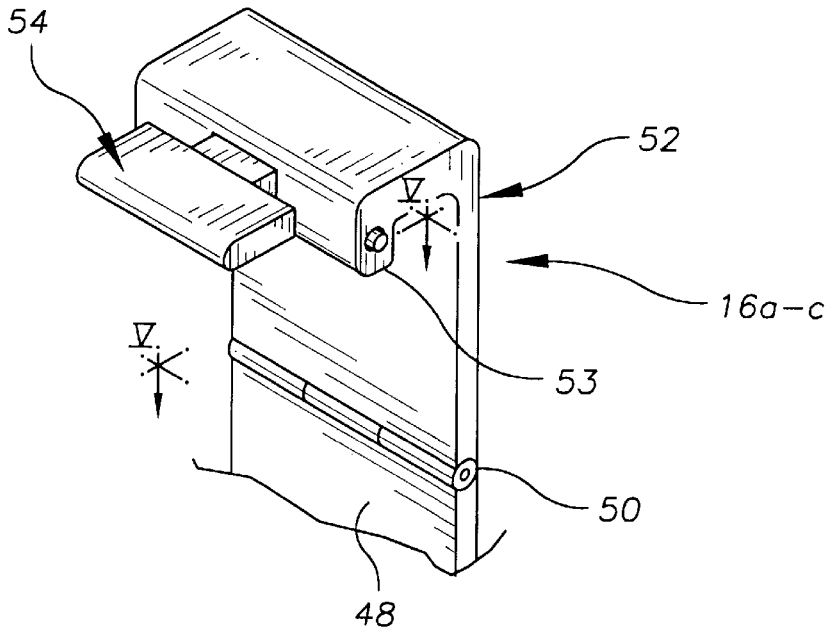
FIG. 4 is a detail perspective view of one of the three pivoting securing assembly showing the lower fixed portion, the assembly hinge, the resilient pivoting clip portion, and the locking bolt assembly with the bolt actuator fully extended and one of the locking bolts fully withdrawn into the resilient pivoting clip portion.
Figure 5:
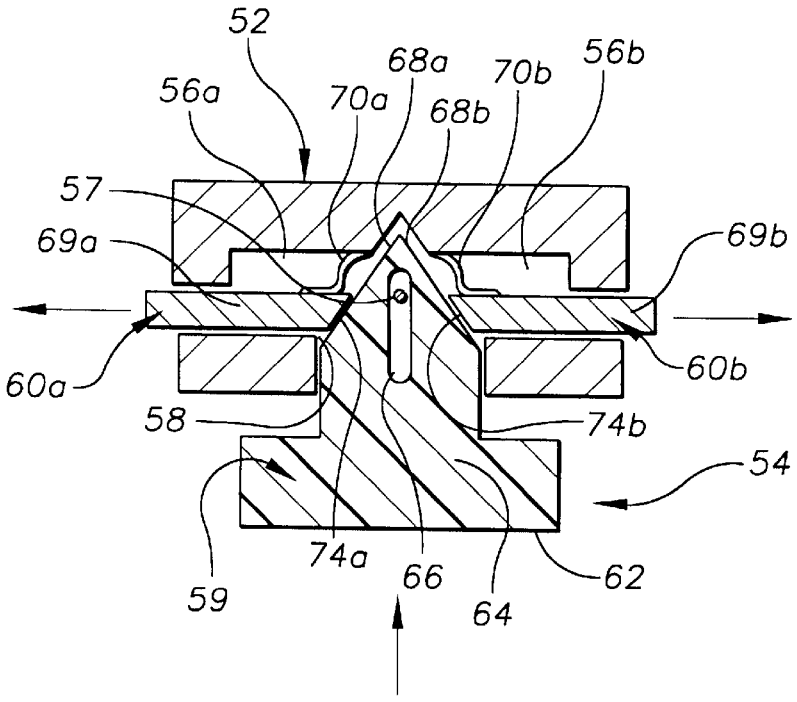
FIG. 5 is a cross section view of a portion of the resilient pivoting clip portion and the locking bolt assembly along the line 5—5 of FIG. 4 showing the bolt actuator in the fully extended position including the head portion and the body portion including the guide slot and two bolt contacting surfaces; and the two slidably mounted locking bolts each having an angled actuator contact surface and a resilient return band connected to an interior surface of the pivoting clip portion.

With reference now to FIG. 4, each pivoting securing mechanism 16*a–c* includes a lower fixed portion 48 that is affixed respectively to tool box portion 22 (FIG. 2) or tool chest member 12 (FIG. 2); an assembly hinge 50; a resilient pivoting clip portion, generally designated 52, having an engaging lip 53; and locking bolt assembly, generally designated 54. With reference to FIG. 5, resilient pivoting clip portion 52 has a locking mechanism chamber system formed therein that includes two locking bolt slide chambers 56*a*, 56*b* and an actuator slide chamber 58. Locking bolt slide chambers 56*a*,56*b* and actuator slide chamber 58 are interlinked in a generally T-shaped configuration. A guide pin 57 extends into the locking mechanism chamber system at the general location of the point of intersection of locking bolt slide chambers 56*a*,56*b* and actuator slide chamber 58.

Locking bolt assembly 54 includes a bolt actuator member, generally designated 59; and two locking bolt assemblies, generally designated 60*a*,60*b*. Bolt actuator member 59 is molded of a hard plastic and includes a head portion 62 and a body portion 64. Body portion 64 has a guide slot 66 formed along the direction of actuator travel and two angled bolt contacting surfaces 68*a*,68*b*. Guide pin 57 extends through guide slot 66. Body portion 64 is slidably disposed through actuator slide chamber 58.

Locking bolt assemblies 60*a*,60*b* each include a steel locking bolt 69*a*,69*b* that is slidably positioned, respectively, within a locking bolt slide chamber 56*a*,56*b*; and a resilient return band 70*a*,70*b* that is connected between its respective steel locking bolt 69*a*,69*b* and pivoting clip portion 52. Each steel locking bolt 69*a,*69*b* has an angled actuator contact surface 74*a,*74*b* that is slidably biased toward and positioned against one of said two bolt contacting surfaces 68*a,*68*b* of bolt actuator member 59.

Figure 6:
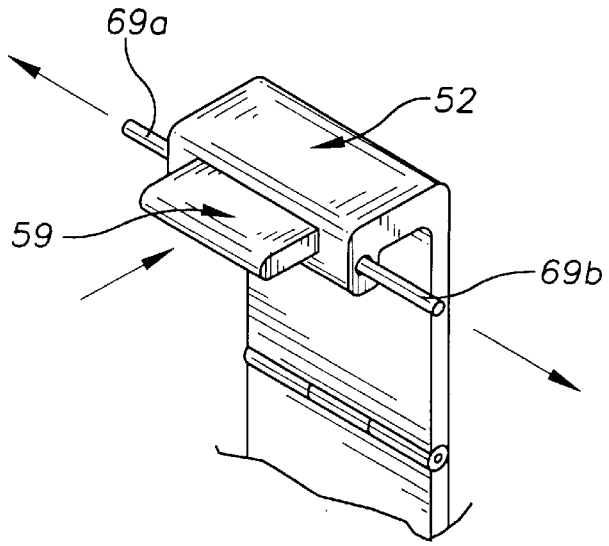
FIG. 6 is a detail perspective view of the pivoting securing assembly showing the two locking bolts of the locking bolt assembly fully extended from the resilient pivoting portion and the bolt actuator in the fully depressed position.
Figure 7:
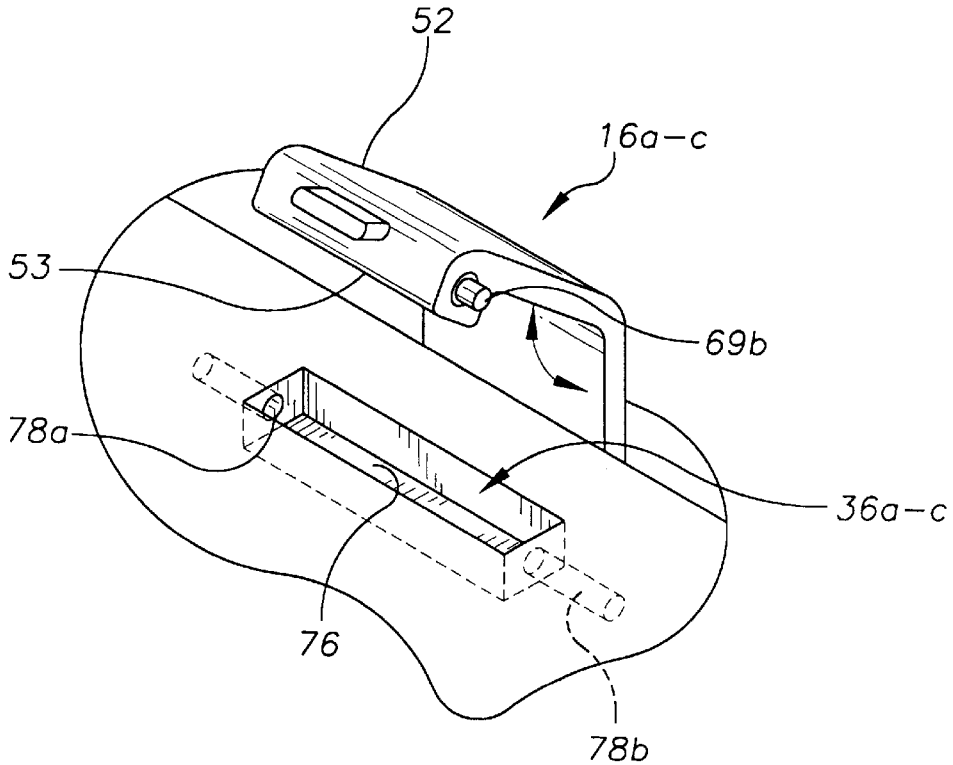
FIG. 7 is a partial detail view of one of the three identical securing bolt receiving depressions showing the central open depression and the two cylinder shaped bolt receiving cavities.

With reference to FIG. 6, when actuator member 59 is pushed inward toward pivoting clip portion 52, bolt contacting surfaces 68*a,*68*b* (FIG. 5) of bolt actuator member 59 contact angled actuator contact surfaces 74*a,*74*b* (FIG. 5) of locking bolts 69*a,*69*b*; forcing locking bolts 69*a,*69*b* to slide outward away from pivoting clip portion 52. With reference to FIG. 7, in use, pivoting securing mechanisms 16*a–c* are used in conjunction with securing bolt receiving depressions 36*a–c*. Each securing bolt receiving depression 36*a–c* includes a centrally positioned, open topped, lip receiving depression 76 and two cylinder shaped bolt receiving cavities 78*a,*78*b*. Central open lip receiving depression 76 is sized to receive the engagement lip 53 of pivoting clip portion 52. Bolt receiving cavities 78*a,*78*b* are sized, respectively, to receive a portion of a locking bolt 69*a,*69*b* (locking bolt 69*a* is shown in FIG. 6) and are positioned such that, when engagement lip 53 is positioned fully within central open lip receiving depression 76, locking bolts 69*a,*69*b* are in alignment with bolt receiving cavities 78*a,* 78*b*.

It can be seen from the preceding description that a combination tool box has been provided that includes a tool box storage cavity for storing smaller tools, such as screw drivers wrenches and the like, and a separate tool chest storage compartment for storing larger tools, such as power drills, jig saws and the like; that includes a tool box and a tool chest that are detachable from each other but that are linked together to allow both the tool box and the tool chest to be lifted by a single handle; and that includes a lower tool chest member, a completely detachable, combined tool chest lid member and top tool box, and three pivoting securing mechanisms; the lower chest member having two pivoting securing assemblies attached to opposed sidewalls thereof, a tool storage compartment formed therein and a chest opening in connection with the tool storage compartment; the combined tool chest lid member and top tool box including a lid portion that is sized and shaped seal the chest opening of the lower chest member, a tool box portion integrally formed with the lid portion having a tool box storage cavity formed therein and a pivoting securing assembly attached to a tool box wall thereof, a hinged tool box top having a handle receiving recess formed therein, and a pivoting handle pivotally attached to the hinged tool box top in a manner to pivot into the handle receiving recess; each of the three pivoting securing assemblies including a lower fixed portion, an assembly hinge, a resilient pivoting clip portion, and a locking bolt assembly including a bolt actuator having a head portion and a body portion including a guide slot and two bolt contacting surfaces; and two slidably mounted locking bolts each having an angled actuator contact surface and a resilient return band connected to an interior surface of the pivoting clip portion; the lid portion including two lid portion receiving depressions each including a lid portion central open depression and two lid portion cylinder shaped bolt receiving cavities formed therein; the hinged tool box top having a box top receiving depression formed therein that includes a box top central open depression and two box top cylinder shaped bolt receiving cavities; the lid portion providing a tool positioning surface having the tool box portion extending outwardly away from the center thereof.

It is noted that the embodiment of the combination tool box described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A combination tool box comprising:

a lower tool chest member;

a completely detachable, combined tool chest lid member and top tool box; and three pivoting securing mechanisms;

said lower chest member having two pivoting securing assemblies attached to opposed sidewalls thereof for detachably securing said combined tool chest lid member and top tool box to said lower chest member, a tool storage compartment formed therein and a chest opening in connection with said tool storage compartment;

said combined tool chest lid member and top tool box including a lid portion that is sized and shaped seal said chest opening of said lower chest member, a tool box portion integrally formed with said lid portion having a tool box storage cavity formed therein and a pivoting securing assembly attached to a tool box wall thereof, a hinged tool box top pivotally connecting said hinged tool box top to said tool box portion and having a handle receiving recess formed therein, and a pivoting handle pivotally attached to said hinged tool box top in a manner to pivot into said handle receiving recess;

each of said three pivoting securing assemblies including a lower fixed portion, an assembly hinge, a resilient pivoting clip portion, and a locking bolt assembly;

each locking bolt assembly including a bolt actuator having a head portion and a body portion and two slidably mounted locking bolts;

each of said body portions including a guide slot and two bolt contacting surfaces;

each of said slidably mounted locking bolts having an angled actuator contact surface slidably biased toward and positioned against one of said two bolt contacting surfaces.

2. The combination tool box of claim 1, wherein:

said lid portion includes a tool positioning surface having said tool box portion extending outwardly away from a center thereof.

3. The combination tool box of claim 2, wherein:

said hinged tool box top has a box top securing bolt receiving depression formed therein that includes a box top central open depression and two box top cylinder shaped bolt receiving cavities.

4. The combination tool box of claim 3 wherein:

said lid portion includes two lid portion securing bolt receiving depressions each including a lid portion central open depression and two lid portion cylinder shaped bolt receiving cavities formed therein.

5. The combination tool box of claim 4 wherein:

said angled actuator contact surface of each of said slidably mounted locking bolts is slidably biased toward said one of said two bolt contacting surfaces by a resilient return band connected between each of said slidably mounted locking bolts and an interior surface of said pivoting clip portion.

6. The combination tool box of claim 3 wherein:

said angled actuator contact surface of each of said slidably mounted locking bolts is slidably biased toward said one of said two bolt contacting surfaces by a resilient return band connected between each of said slidably mounted locking bolts and an interior surface of said pivoting clip portion.

7. The combination tool box of claim 2 wherein:

said lid portion includes two lid portion securing bolt receiving depressions each including a lid portion central open depression and two lid portion cylinder shaped bolt receiving cavities formed therein.

8. The combination tool box of claim 7 wherein:

said angled actuator contact surface of each of said slidably mounted locking bolts is slidably biased toward said one of said two bolt contacting surfaces by a resilient return band connected between each of said slidably mounted locking bolts and an interior surface of said pivoting clip portion.

9. The combination tool box of claim 2 wherein:

said angled actuator contact surface of each of said slidably mounted locking bolts is slidably biased toward said one of said two bolt contacting surfaces by a resilient return band connected between each of said slidably mounted locking bolts and an interior surface of said pivoting clip portion.

10. The combination tool box of claim 1, wherein:

said hinged tool box top has a box top securing bolt receiving depression formed therein that includes a box top central open depression and two box top cylinder shaped bolt receiving cavities.

11. The combination tool box of claim 10 wherein:

said lid portion includes two lid portion securing bolt receiving depressions each including a lid portion central open depression and two lid portion cylinder shaped bolt receiving cavities formed therein.

12. The combination tool box of claim 10 wherein:

said angled actuator contact surface of each of said slidably mounted locking bolts is slidably biased toward said one of said two bolt contacting surfaces by a resilient return band connected between each of said slidably mounted locking bolts and an interior surface of said pivoting clip portion.

13. The combination tool box of claim 11 wherein:

said angled actuator contact surface of each of said slidably mounted locking bolts is slidably biased toward said one of said two bolt contacting surfaces by a resilient return band connected between each of said slidably mounted locking bolts and an interior surface of said pivoting clip portion.

14. The combination tool box of claim 1 wherein:

said lid portion includes two lid portion securing bolt receiving depressions each including a lid portion central open depression and two lid portion cylinder shaped bolt receiving cavities formed therein.

15. The combination tool box of claim 14 wherein:

said angled actuator contact surface of each of said slidably mounted locking bolts is slidably biased toward said one of said two bolt contacting surfaces by a resilient return band connected between each of said slidably mounted locking bolts and an interior surface of said pivoting clip portion.

16. The combination tool box of claim 1 wherein:

said angled actuator contact surface of each of said slidably mounted locking bolts is slidably biased toward said one of said two bolt contacting surfaces by a resilient return band connected between each of said slidably mounted locking bolts and an interior surface of said pivoting clip portion.

* * * * *